United States Patent [19]

Nichols et al.

[11] Patent Number: 5,057,646

[45] Date of Patent: Oct. 15, 1991

[54] FOLDED RIBBON CABLE ASSEMBLY HAVING INTEGRAL SHIELDING

[75] Inventors: Edward L. Nichols, Annapolis; Gray L. Stirk, Graysonville, both of Md.

[73] Assignee: Smartouse Limited Partnership, Upper Marlboro, Md.

[21] Appl. No.: 496,979

[22] Filed: Mar. 21, 1990

[51] Int. Cl.[5] ..... H01B 7/34

[52] U.S. Cl. ..... 174/36; 174/115; 174/117 F

[58] Field of Search ..... 174/36, 117 R, 117 F, 174/115

[56] References Cited

U.S. PATENT DOCUMENTS 4,123,753 10/1978 Gravert ..... 174/115 X
4,767,891 8/1988 Biegon et al. ..... 174/36

FOREIGN PATENT DOCUMENTS 213616 8/1986 European Pat. Off. .
3522173 7/1986 Fed. Rep. of Germany .

*Primary Examiner*—Morris H. Nimmo
*Attorney, Agent, or Firm*—Cushman, Darby & Cushman

[57] ABSTRACT

The present invention provides a ribbon cable for conducting AC power and digital data signals. The ribbon cable includes a plurality of spaced, parallel, wire conductors arranged in a row, the conductors including power conductors adaptable for conducting AC power and data conductors adaptable for conducting digital data signals. A pliable insulating material holds together and electrically insulates the conductors. Conductive material, such as a conductive foil or conductive plastic, is disposed either on or inside the insulating material to shield the electromagnetic interference generated by the transmitted AC power from the data conductors. The ribbon cable is then folded in a protective outer jacket so that the conductive material is disposed substantially between the power conductors and the data conductors. This maximizes the electromagnetic interference shielding of the conductive material.

25 Claims, 6 Drawing Sheets

FIG. 3A
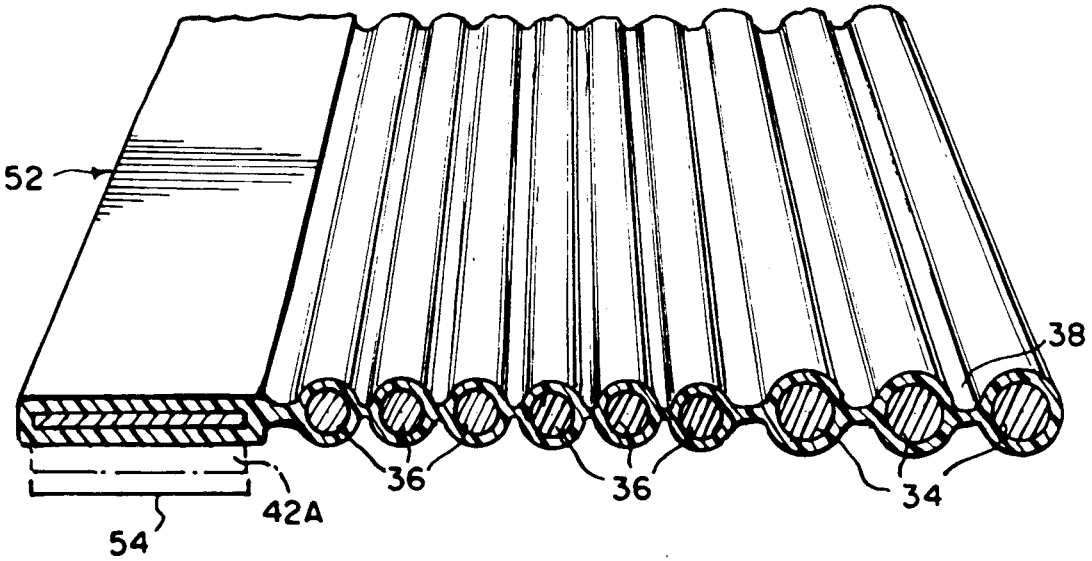
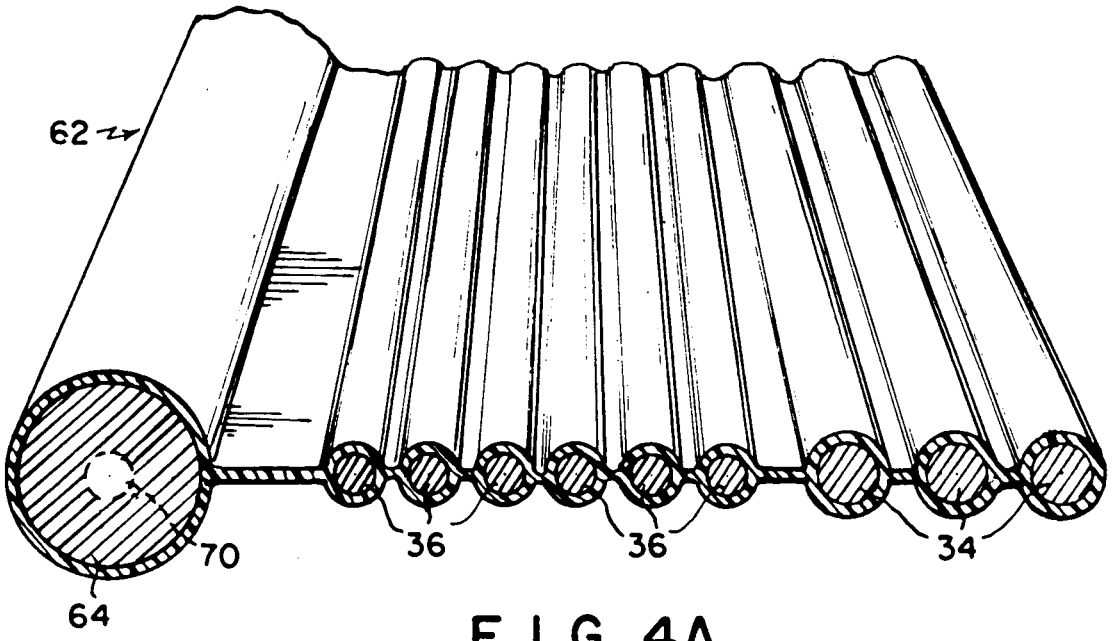
FIG. 4A

FIG. 4B
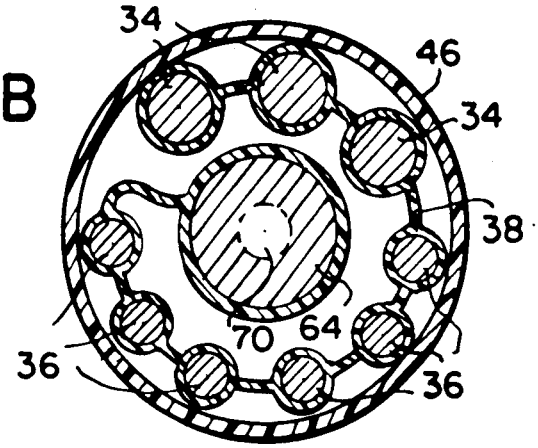
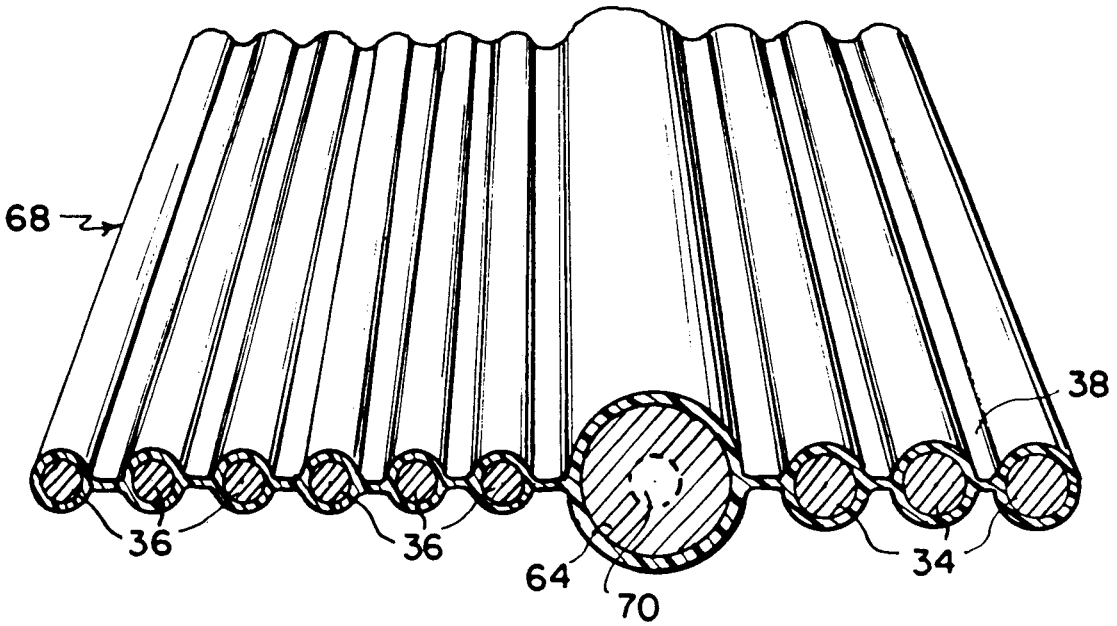
FIG. 5A
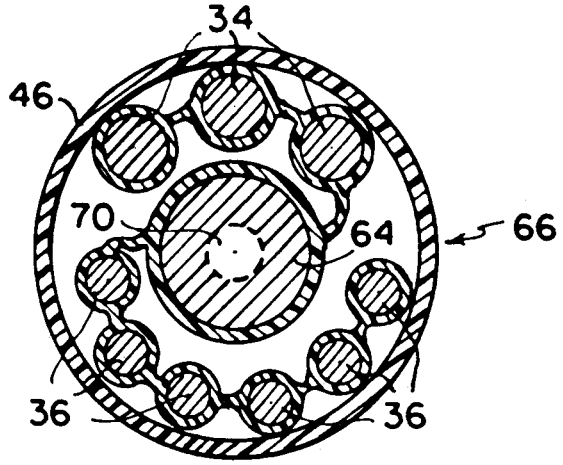
FIG. 5B

FIG. 6A
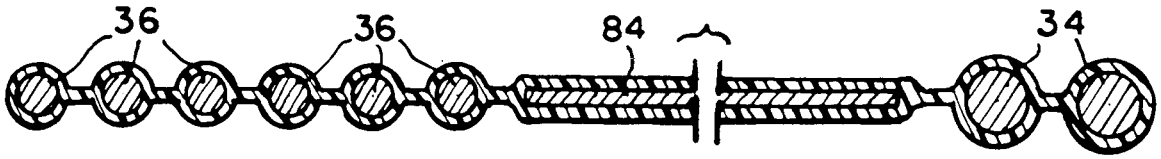
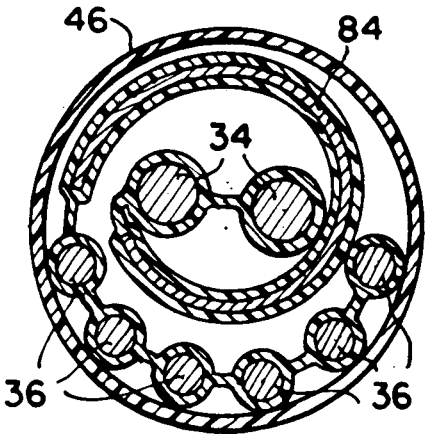
FIG. 6B
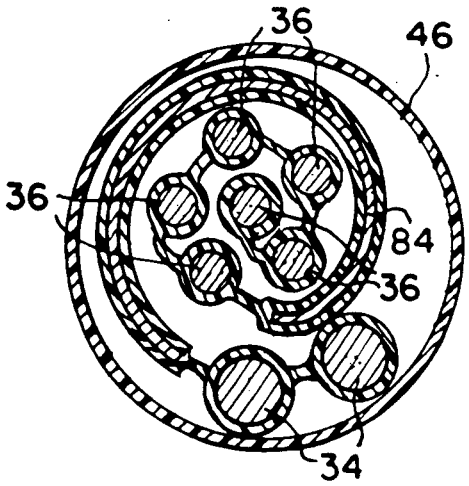
FIG. 6C

FIG. 8B
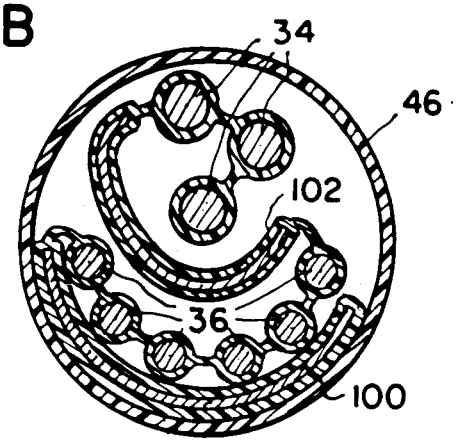
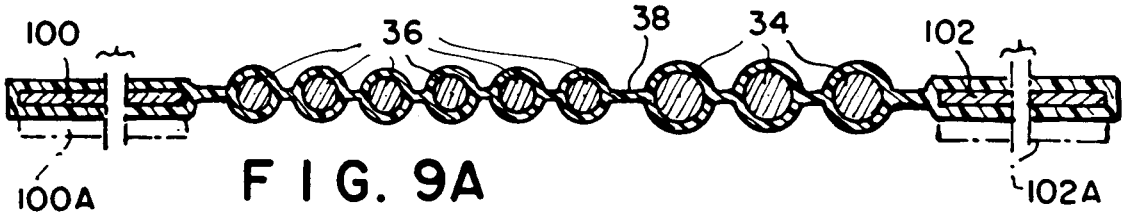
FIG. 9A
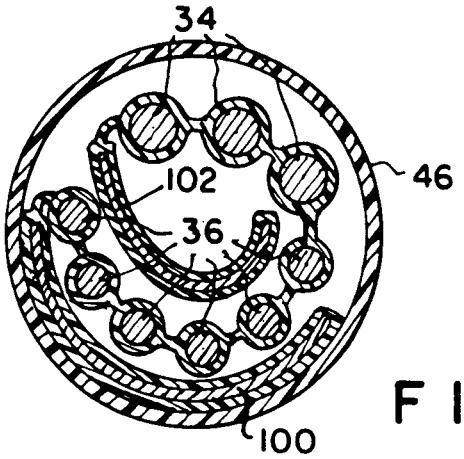
FIG. 9B

FOLDED RIBBON CABLE ASSEMBLY HAVING INTEGRAL SHIELDING

BACKGROUND OF THE INVENTION

1. Field of the Related Art

The present invention relates to a ribbon cable assembly having multiple, parallel conductors.

2. Background of the Invention

Many different types of wiring for transmitting various types of electrical signals are known. Depending on the types of signals being transmitted along the wire, different types of wires are known to give the best performance. For example, twisted wire pairs and coaxial cables typically provide better noise immunity than parallel wires and power applications, such as 120 V AC for example, must have a proper gauge to withstand the driven current.

When wiring a new building, such as a residential home, wires used for different purposes are typically wired separately. Thus, telephone wires, security wiring, and power wiring are all installed separately. This is costly to install and difficult to repair once installed.

To provide a more uniform wiring system, the assignee for this application previously developed a wiring topology that integrates different wires used for different purposes on a single ribbon cable assembly, which is the subject of a separate patent application bearing U.S. Ser. No 07/464,131 and the title "Improved Wiring Topology For Use In Constructing New Homes", which is expressly incorporated by reference into this application.

As illustrated in FIG. 1, this ribbon cable assembly 10 includes a ribbon cable 12 having power conductors 14 with positive, neutral, and ground wires of #12–14 gauge, respectively. Data conductors 16, made of a plurality of #24 gauge wires, are also provided for transmitting digital data communications. This ribbon cable 12 is then folded inside a protective outer jacket 18. Also disposed inside the outer jacket was a protective insulation 20, such as polyethylene, to keep the power conductors 14 and the data conductors 16 spaced apart to improve the signal to noise ratio on the data conductors.

However, it has been determined that the closeness of the power conductors 14 and data conductors 16, as well as the fact that the data conductors 16 are parallel wires, prevents the proper trans mission of digital data along data conductors due to electromagnetic interference generated by the power conductors 14. The presence of the protective insulation was not as effective as required for proper transmission of the digital data along data conductors 16.

Known shielding techniques typically surround the wires to be shielded with a conductive foil or conductive wire mesh. However, this type of shielding is expensive, very labor intensive, and difficult to splice.

SUMMARY OF THE INVENTION

Therefore, it is an object of the present invention to provide a ribbon cable that integrates different wires used for different purposes and also effectively shields these different wires from electromagnetic interference generated from each other.

It is a further object of the present invention to provide a ribbon cable that integrates AC power conductors for transmitting AC power and data conductors for transmitting digital data signals and effectively shields the data conductors from electromagnetic interference generated in the power conductors and shields the power conductors from interference generated by the data conductors.

It is also an object of the invention to provide a ribbon cable assembly that can have different segments of the ribbon cable easily spliced together, even with the shielding on the cable so that insulation displacement connectors inserted into the ribbon cable are not affected by the shielding.

It is still a further object to provide a ribbon cable that can shield the various conductors from electromagnetic interference at a low cost.

To meet the above recited objects, the present invention provides a ribbon cable for conducting AC power are digital data signals. The ribbon cable includes a plurality of spaced, parallel, wire conductors arranged in a row, the conductors including power conductors adaptable for conducting AC power and data conductors adaptable for conducting digital data signals. A pliable insulating material holds together and electrically insulates the conductors. Conductive material, such as a conductive foil, film, paint or plastic, is disposed either on or inside the insulating material to shield the electromagnetic interference generated by the transmitted AC power from the data conductors. The ribbon cable is then folded in a protective outer jacket so that the conductive material is disposed substantially between the power conductors and the data conductors. This maximizes the electromagnetic interference shielding of the conductive material.

In a specific embodiment of the invention, a flat conductor is used as the ground wire for AC power and also provides the electromagnetic shielding. This flat ground conductor is preferably placed between the positive and neutral AC wires and the adjacent wires used as the data conductors. When folded inside the outer jacket, this flat ground conductor then shields the data conductors to reduce the electromagnetic interference on the data conductors.

BRIEF DESCRIPTION OF THE DRAWINGS

These and other advantages of the present invention may be appreciated from studying the following detailed description of the preferred embodiment together with the drawings in which:

FIGS. 3A–3B illustrate a second embodiment of the ribbon cable and the ribbon cable assembly;

FIGS. 4A–4B illustrate a third embodiment of the ribbon cable and the ribbon cable assembly;

FIGS. 5A–5B illustrate a fourth embodiment of the ribbon cable and the ribbon cable assembly;

FIGS. 6C–6C illustrate a fifth embodiment of the ribbon cable and the ribbon cable assembly;

FIGS. 8A–8B illustrate a seventh embodiment of the ribbon cable and the ribbon cable assembly; and FIGS 9A–9B illustrate a eighth embodiment of the ribbon cable and the ribbon cable assembly.

DETAILED DESCRIPTION OF THE PREFERRED EMBODIMENT

Figure 1:
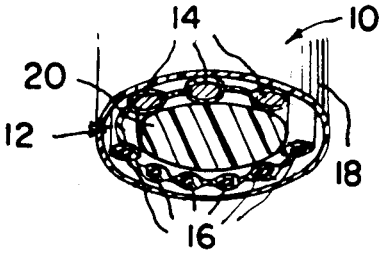
FIG. 1 (PRIOR ART)
FIG 1 illustrates a ribbon cable according to the prior art.
Figure 2A:
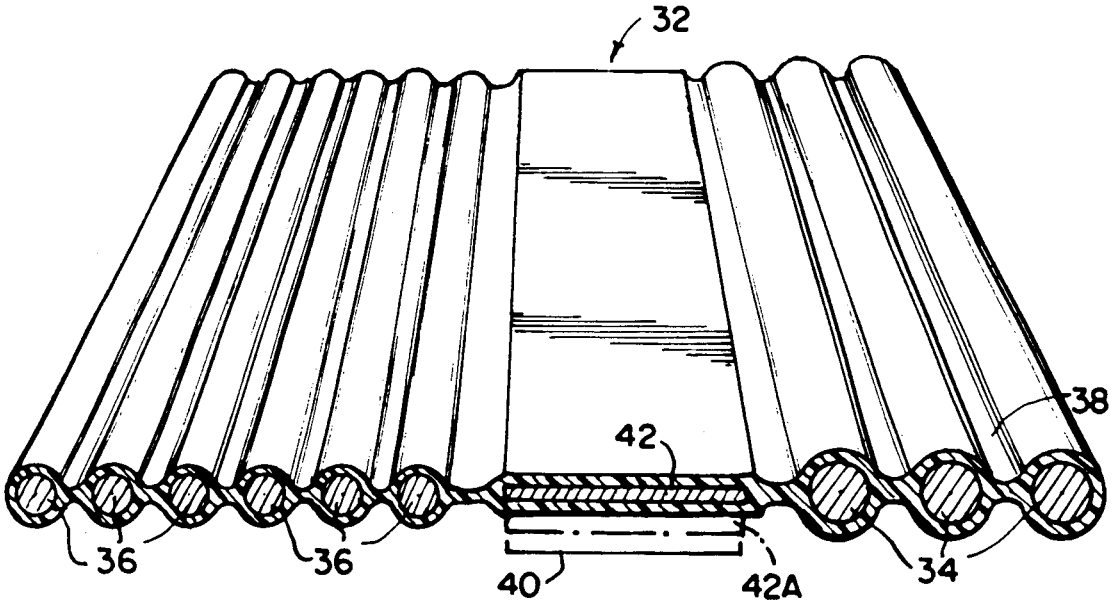
FIGS. 2A–2B illustrate a first embodiment of the ribbon cable and the ribbon cable assembly.
Figure 2B:
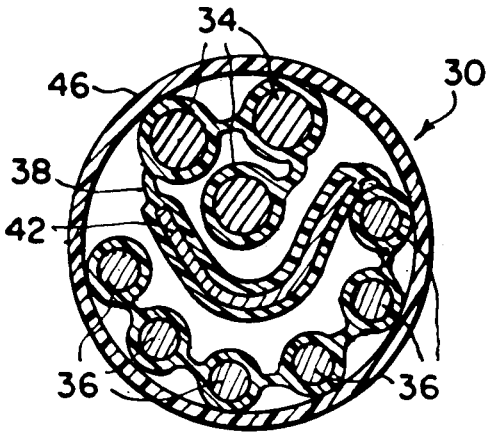

FIGS. 2A-2C illustrates of first embodiment of the present invention, referred to as ribbon cable assembly 30. Ribbon cable assembly 30 includes a ribbon cable 32, having a plurality of parallel conductors including adjacent power conductors 34 and adjacent data conductors 36.

Power conductors 34 capable of transmitting 120 V AC power include positive, neutral and ground wires that are preferably made of #12 gauge copper wire, spaced at 0.25 inch centers, except the outermost "hot" conductor being spaced 0.35 inches from the adjacent neutral conductor. As illustrated in FIG. 2A, the outermost conductor 34 is the positive, or "hot" conductor, the middle conductor 34 is the neutral conductor, and the other end conductor 34 is the ground conductor.

Data conductors 36 are preferable made of #24 gauge copper wire, are spaced 0.1 inch centers, and are capable of transmitting digital data signals, and clock signals, preferably differentially driven signals.

Each of these conductors 34 and 36 are formed in insulation 38, which is PVC (polyvinylchloride), a pliable plastic, and typically used when making ribbon cables. FIG. 2A further illustrates that between and running parallel to power conductors 34 and data conductors 36 is disposed an area 40 that is used for placement of a conductive shield 42. Conductive shield 42 can be placed within insulation 38 as illustrated in FIG. 2A, or on the outside of insulation 38, as illustrated in dotted line and labelled 42A. In either case, conductive shield preferably has a width of approximately 0.5 inches, the purpose of this dimension becoming apparent hereinafter. However, other widths for varying configurations can also be used. When placed within insulation 38, conductive shield 42 is preferably a flat wire, such as aluminum or copper, or a wire mesh screen having a finer pitch, such as about 33 squares per inch. When mounted on the outside of insulation 38, conductive shield 42A is preferably a copper foil that can be mounted adhesively or with heat or a graphite, nickel conductive paint. A conductive film, embedded in insulation 38 can also be used. The conductive shield 42 or 42A preferably has a thickness of less than 0.001 inches. However, larger thickness, although awkward, could be used. For purposes of manufacture, the conductive foil, which is made up of conductive particles deposited on mylar, mounted on insulation 38 is most preferred.

FIG. 2B illustrates ribbon cable 32 after being folded and placed within outer jacket 46, so that the final form of ribbon cable assembly 30 results. Outer jacket 46 is formed of PVC. Ribbon cable 32 is folded such that the conductive shield 42 is between power conductors 34 and data conductors 36. Outer jacket 46 has a circular dimension that keeps ribbon cable 42 folded in this manner.

The width of conductive shield 42, previously given as about 0.5 inches for the conductor spacings recited, ensures that all of the data conductors 36 are shielded and electromagnetic interference generated by AC power transmitted through power conductors 34 is minimized. The present inventors have determined that the noise level present in the data conductors 36, which originates due to the capacitive effect between power conductors 34 and data conductors 36, is reduced at least 20 Db for frequencies below 250 Khz with conductive shield 42 than the noise level without conductive shield 42. Attenuation of noise decreases as the frequency of the noise increases above 250 Khz.

Figure 3B:
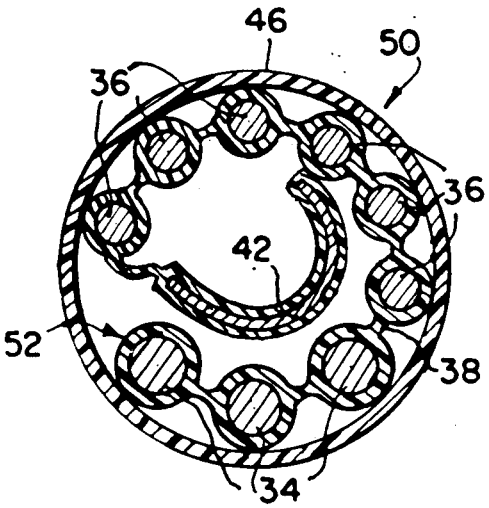
Figure 7A:
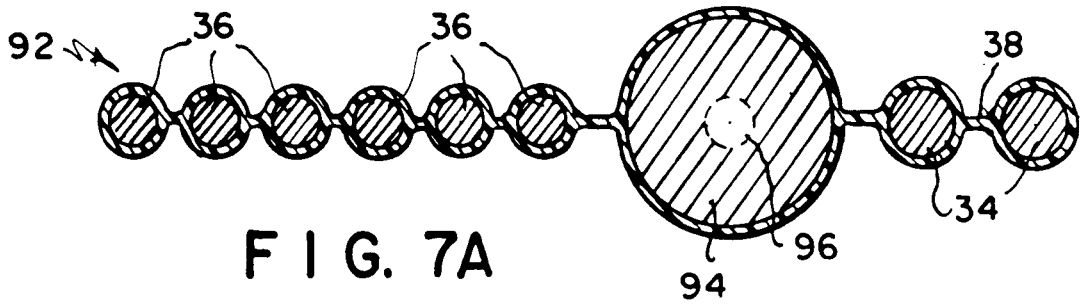
FIGS. 7A–7B illustrate a sixth embodiment of the ribbon cable and the ribbon cable assembly.
Figure 7B:
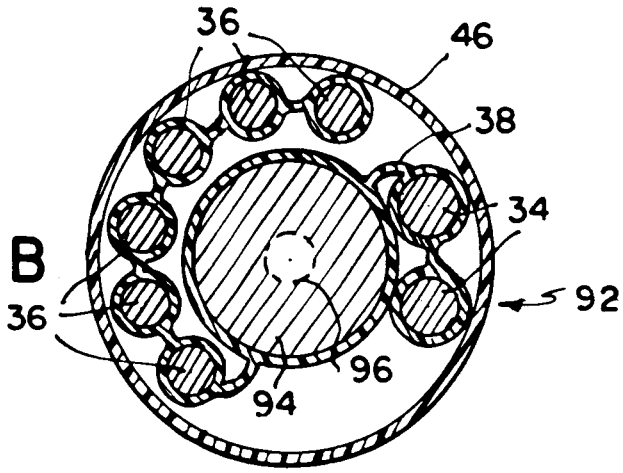
Figure 8A:
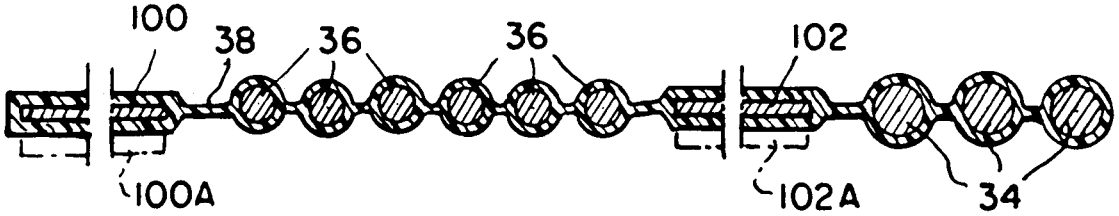

FIGS. 3A and 3B illustrate the second embodiment of the present invention. For this and later described embodiments, like elements will be labelled similarly. In this embodiment, ribbon cable assembly 50 contains a ribbon cable 52 constructed of power conductors 34 and data conductors 36 that are parallel and mounted in an insulator 38. The difference of this second embodiment is that the conductive shield 42 is not between power conductors 34 and data conductors 36, but instead on the outside end of data conductors 36, in area 54. The resulting ribbon cable assembly 50 performs the same shielding function because conductive shield 42 is disposed between power conductors 34 and data conductors 36. However, ribbon cable 52 must be folded differently inside outer jacket 46. It should also be noted that area 54 could also be disposed at the outside end of power conductors 34.

FIGS. 4A and 4B illustrate ribbon cable assembly 60, which is a third embodiment of the present invention. The difference between the second and third embodiment is that ribbon cable 62 includes a cylindrical conductive shield 64 made from a cylindrical conductive plastic having a conductivity of about 0.1 per microhm-cm, which is roughly equivalent to the conductivity of iron. Cylindrical conductive shield 64 has a diameter of about 0.35 inches so that electromagnetic interference, generated by AC power transmitted through power conductors 34, is minimized on data conductors 36 when ribbon cable 62 is folded within outer jacket 46. Once again, these dimensions and conductivity values can change for varying configurations.

FIGS. 5A-5B illustrates the ribbon cable assembly 66, which is a fourth embodiment of the present invention and is a combination of the first and third embodiments that uses a cylindrical conductive shield 64 as in the third embodiment that is placed in an area 40 as in the first embodiment. The resulting ribbon cable 68 is folded within outer jacket 46 so that the proper placement to minimize electromagnetic interference on data conductors 36 is obtained.

It should be noted that within cylindrical conductive shield 64 there can be placed a copper wire 70 (illustrated in dotted line in FIGS. 4A and 5A), such as a #24 gauge copper wire, to further enhance the shielding effect.

FIGS. 6A-6C and 7A-7B show fifth and sixth embodiment of the present invention, which are labelled ribbon cable assemblies 80 and 90, respectively. Both of these embodiments are similar because they combine the AC ground wire and the conductive shield in a single conductive member.

With respect to the fifth embodiment, conductive member 84, which is illustrated in FIGS. 6A and 6B, is a flat cable that electrically is the equivalent of a 14 gauge wire. However, conductive member 84 also has a width that is about 1.2 inches for the spacings recited previously This width, when used with the spacing of 0.25 inches between the positive and neutral power conductors, can fully surround the positive and neutral power conductors to minimize the effect of the electromagnetic interference generated from the positive power conductor on the data conductors 36. FIG. 6C illustrates wrapping data conductors 36 inside conductive member 84.

The sixth embodiment uses a cylindrical conductive member 94 made from a cylindrical conductive plastic having a conductivity that is the same as cylindrical conductive shield 64. Cylindrical conductive member 94, like cylindrical conductive shield 64 illustrated in FIG. 4A, has a diameter of 0.35 inches so that electromagnetic interference, generated by AC power transmitted through power conductors 34, is minimized on data conductors 36 when ribbon cable 92 is folded within outer jacket 46. However, cylindrical conductive member 94 necessarily includes a ground wire 96 having an appropriate gauge, such as 14 gauge copper wire, at its center to provide an effective ground conductor for AC power.

It should be also be noted that in all of the following embodiment that the resulting ribbon cable, such as ribbon cable 32 in the first embodiment, can be easily spliced together. Furthermore, the location of the conductive shield, such as conductive shield 42 in the first embodiment, allows splicing of the conductive shield, as well as the other conductors, without difficulty. One of the reasons that splicing is easy is because it is located in a different area than each of the power conductors 34 and data conductors 36, in contrast to known shielding techniques in which the shield surrounds the conductors, as previously described.

FIGS. 8A–8B and 9A–9B illustrate seventh and eighth embodiments, respectively, which include two conductive shields 100 and 102, or 100A and 102A, which can be formed as either conductive shield 42 or 42A described previously. The location of conductive shields 100 and 102 varies in the seventh and eighth embodiments, as illustrated, but both perform a similar function, which is to isolate both sides of data conductors 36. This further isolation is advantageous in applications where multiple ribbon cable assemblies will be next to each other and the possibility that power conductors 36 from an adjacent ribbon cable assembly could be the source of electromagnetic interference. These embodiments minimize this possibility.

While the invention has been described in connection with what is presently considered to be the most practical and preferred embodiments, it is understood that the invention is not limited to the disclosed embodiment, but, on the contrary, is intended to cover various modifications and equivalent arrangements included within the spirit and scope of the appended claims.

We claim:

1. A ribbon cable assembly for conducting AC power and digital data signals comprising:

means for conducting AC power and digital data signals comprising:

a plurality of spaced, parallel, wire conductors arranged in a row, said conductors comprising at least three adjacent power conductors adaptable for conducting said AC power and at least two adjacent data conductors adaptable for conducting said digital data signals, an insulating material for holding together and electrically insulating each of said plurality of conductors, and means for shielding electromagnetic interference generated by AC power transmitted along said power conductors from said data conductors, said shielding means comprising an electrically conductive material arranged parallel to said plurality of wire conductors; an an outer jacket enclosing said conducting means said conducting means being folded inside said outer jacket so that said shielding means is disposed substantially between said power conductors and said data conductors to maximize the electromagnetic interference shielding of said shielding means.

2. A ribbon cable assembly according to claim 1 wherein said shielding means is disposed within said insulating material between said power conductors and said data conductors.

3. A ribbon cable assembly according to claim 2 wherein said shielding means comprises a conductive foil having a width that is greater than the spaced distance between two of said at least three power conductors.

4. A ribbon cable assembly according to claim 2 wherein said shielding means comprises a conductive plastic.

5. A ribbon cable assembly according to claim 4 wherein said conductive plastic has a cylindrical shape with a diameter such that when said conductor means is folded inside said outer jacket the spaced distance between two of said at least three power conductors is less than one half of said circumference of said cylindrical conductive plastic.

6. A ribbon cable assembly according to claim 5 wherein said shielding means further comprises a wire disposed within said conductive plastic.

7. A ribbon cable assembly according to claim 1 wherein said shielding means is disposed on an outer surface of said insulating material between said power conductors and said data conductors and has a width that is greater than the spaced distance between two of said at least three power conductors.

8. A ribbon cable assembly according to claim 7 wherein said shielding means is one of a conductive foil, conductive paint, and conductive film.

9. A ribbon cable assembly according to claim 1 wherein said power conductors and said data conductors are adjacent within said insulating material and said shielding means is disposed within said insulating material adjacent to one of said power conductors and said data conductors.

10. A ribbon cable assembly according to claim 9 wherein said shielding means comprises a conductive foil having a width that is greater than the spaced distance between two of said at least three power conductors.

11. A ribbon cable assembly according to claim 9 wherein said shielding means comprises a conductive plastic.

12. A ribbon cable assembly according to claim 11 wherein said conductive plastic has a cylindrical shape with a diameter such that when said conductor means is folded inside said outer jacket the spaced distance between two of said at least three power conductors is less than one half of said circumference of said cylindrical conductive member.

13. A ribbon cable assembly according to claim 11 wherein said shielding means further comprises a wire disposed within said conductive plastic.

14. A ribbon cable assembly according to claim 1 wherein said shielding means is disposed on an outer surface of said insulating material adjacent to only one of said data conductors and power conductors and has a width that is greater than the spaced distance between two of said at least three power conductors.

15. A ribbon cable assembly according to claim 1 wherein said shielding means is one of a conductive foil, conductive paint, and conductive film.

16. A ribbon cable assembly for conducting AC power and digital data signals comprising:

means for conducting AC power and digital data signals comprising:

a plurality of spaced, parallel, wire conductors arranged in a row, said conductors comprising at least two adjacent power conductors adaptable for conducting said AC power and at least two adjacent data conductors adaptable for conducting said digital data signals, an insulating material for electrically insulating each of said plurality of conductors, and shielding means for providing an AC ground and shielding electromagnetic interference generated by AC power transmitted along said power conductors from said data conductors, said shielding means comprising an electrically conductive material arranged parallel to said plurality of wire conductors; and an outer jacket enclosing said conducting means said conducting means being folded inside said outer jacket so that said shielding means is disposed substantially between said power conductors and said data conductors to maximize the electromagnetic interference shielding of said shielding means.

17. A ribbon cable assembly according to claim 16 wherein said shielding means is disposed within said insulating material between said power conductors and said data conductors.

18. A ribbon cable assembly according to claim 17 wherein said shielding means comprises a flat conductor having a width that is greater than the spaced distance between said at least two power conductors.

19. A ribbon cable assembly according to claim 17 wherein said shielding means is folded fully around said power conductors and comprises a flat conductor having a width that fully surrounds said power conductors.

20. A ribbon cable assembly according to claim 17 wherein said shielding means is folded fully around said data conductors and comprises a flat conductor having a width that fully surrounds said data conductors.

21. A ribbon cable assembly for conducting AC power and digital data signals comprising:

means for conducting AC power and digital data signals comprising:

a plurality of spaced, parallel, wire conductors arranged in a row, said conductors comprising at least three adjacent power conductors adaptable for conducting said AC power and at least two adjacent data conductors adaptable for conducting said digital data signals, an insulating material for holding together and electrically insulating each of said plurality of conductors, and means for shielding electromagnetic interference generated by AC power transmitted along said power conductors from said data conductors, said shielding means comprising first and second electrically conductive materials arranged parallel to said plurality of wire conductors and electrically isolated from each other; and an outer jacket enclosing said conducting means said conducting means being folded inside said outer jacket so that one of said first and second electrically conductive materials is disposed substantially between said power conductors and said data conductors and the other of said first and second electrically conductive materials is disposed between said data conductors and said outer jacket to maximize the electromagnetic interference shielding of said shielding means.

22. A ribbon cable assembly according to claim 21 wherein said first electrically conductive material is disposed within said insulating material between said power conductors and said data conductors and said second electrically conductive material is disposed adjacent within said insulating material to said data conductors.

23. A ribbon cable assembly according to claim 22 wherein said first and second electrically conductive materials comprise a conductive foil.

24. A ribbon cable assembly according to claim 21 wherein said first and second electrically conductive materials are disposed on an outer surface of said insulating material.

25. A ribbon cable assembly according to claim 24 wherein said first and second electrically conductive materials are one of a conductive foil, conductive paint, and conductive film.

* * * * *